United States Patent [19]

Maeda et al.

[11] Patent Number: 4,730,548

[45] Date of Patent: Mar. 15, 1988

[54] LIGHT METAL ALLOY PISTON

[75] Inventors: Yorishige Maeda; Yoshiaki Tatematsu; Atsuo Tanaka, all of Toyota; Shiro Machida, Okazaki, all of Japan

[73] Assignees: Toyota Jidosha Kabushiki Kaisha, Toyota; Aisin Seiki Kabushiki Kaisha, Kariya, both of Japan

[21] Appl. No.: 823,480

[22] Filed: Jan. 28, 1986

[30] Foreign Application Priority Data

Feb. 2, 1985 [JP] Japan ..... 60-17711
Mar. 1, 1985 [JP] Japan ..... 60-38921

[51] Int. Cl.[4] ..... F02F 3/08
[52] U.S. Cl. ..... 92/225; 92/229; 123/193 P
[58] Field of Search ..... 92/225, 228, 229, 230; 123/193 P

[56] References Cited

U.S. PATENT DOCUMENTS 4,274,372 6/1981 Kelm ..... 123/193 P
4,359,973 11/1982 Shimada ..... 123/193 P X

FOREIGN PATENT DOCUMENTS 617402 8/1935 Fed. Rep. of Germany .
2639294 9/1978 Fed. Rep. of Germany .
59-229033 12/1984 Japan .
894380 4/1962 United Kingdom ..... 123/193 P
1598680 9/1981 United Kingdom ..... 123/193 P

OTHER PUBLICATIONS

JP Abstract 59-201 953.
MTZ Motortechnische Zeitschrift, 43, 1982, No. 7, p. 492.

*Primary Examiner*—Harold W. Weakley
*Attorney, Agent, or Firm*—Cushman, Darby & Cushman

[57] ABSTRACT

A light metal alloy cast piston comprises a thermal strut provided in the shoulder portion of the piston skirt. The thermal strut is composed of a fiber reinforced metal portion containing high tensile strength fibers integrally molded in the matrix metal. The piston is shaped in such a manner that the inner periphery of the thermal strut is exposed toward the inside of the piston skirt, except for the regions at the piston pin bosses, to avoid the presence of non-reinforced metal a the inside of the thermal strut. This arrangement prevents the formation of cracks along the inner periphery of the thermal strut.

2 Claims, 11 Drawing Figures

LIGHT METAL ALLOY PISTON

BACKGROUND OF THE INVENTION

1. Field of the Invention

The present invention relates to a fiber-reinforced light metal alloy piston for internal combustion engines.

2. Description of the Related Art

It is well known to manufacture internal combustion engine pistons from light metal alloy castings such as aluminum alloys. Since light metal alloys have a larger coefficient of linear expansion as compared with steel alloys, the skirt section of the light metal alloy piston is subjected to considerable thermal deformation between the cold start condition and the warmed up condition of the engine. If the piston skirt section is so sized as to provide little clearance between the outer periphery thereof and the inner surface of the cylinder bore during cold start of the engine, then the friction between the piston skirt and the cylinder bore would become prohibitively high when the engine is warmed up, since the piston clearance in the bore is reduced due to thermal expansion of the piston skirt section. Conversely, if the clearance is large enough to avoid the above-mentioned problem, then the engine will generate piston slap to an unacceptable level during cold start of the engine, because of the excessive clearance between the piston shirt and cylinder bore. In order to meet these opposing requirements, it is desirable to suppress thermal expansion of the light metal alloy piston skirt section so that an optimum clearance is maintained regardless of the engine temperature.

One solution known in the art is to thermally isolate the skirt section from the heated piston crown section by means of a plurality of slits extending through the wall of the skirt perpendicular to the longitudinal axis of the piston. These slits communicate the oil ring groove with the inside of the piston and are primarily intended as oil passages serving to direct oil scraped from the surface of the cylinder bore by the oil control ring toward the interior of the piston. These slits have been found to act as a heat dam that prevents the transfer of heat from the piston crown to the skirt section. However, in supercharged high-speed high-power engines, the pistons tend to be subjected to increasingly high heat loads. Therefore, in such high power engines, it is desirable to dissipate heat through the piston skirt section, although most of the heat received by the piston crown from the combustion chamber is primarily transferred through piston rings to the engine cylinders. For this reason, the recent trend in high power engines is to reduce or even abolish the heat dam slits located between the piston crown and the skirt section. This causes the temperature of the skirt section to be elevated by 30° to 40° C. as compared with conventional non-supercharged engines, resulting in considerable thermal deformation of the skirt section.

Another solution is to provide within the skirt section a steel ring known as a "thermal strut" and having a high tensile strength sufficient to prevent thermal expansion of the piston skirt. The thermal strut is in the form of an insert and is molded within the matrix of the light metal alloy by an insert casting technique. The disadvantage of such a steel thermal strut is that it increases the weight of the piston and, thus, becomes a bar to designing light weight pistons.

It has been proposed, therefore, to use thermal struts made from fiber reinforced light metal alloys, instead of steel thermal struts, as disclosed, for example, in Japanese Unexamined Patent Publication (Kokai) Nos. 59-229033 and 59-229034, and Japanese Unexamined Utility Model Publication (Kokai) Nos. 60-12650, 60-28246, 60-28247, and 60-28248. The thermal strut of fiber reinforced light metal alloys comprises a circumferentially wound bundle of high-tensile-strength inorganic fibers, such as carbon fibers and silicon carbide fibers, which are integrally molded within a matrix light metal alloy to form an annular fiber-reinforced portion within the confinement of the shoulder portion of the skirt section. In the fiber reinforced portion, individual fibers are firmly bonded to the matrix metal. Due to the low coefficient of linear thermal expansion of the high tensile strength fibers, the annular fiber-reinforced portion serves as a thermal strut which precludes thermal expansion of the shoulder portion of the skirt section.

However, the problem which must be overcome in the manufacture of light-metal-alloy casted pistons having thermal struts comprising inorganic reinforcing fibers is that cracks are formed in the matrix metal of the skirt shoulder portion in the vicinity of the boundary of the fiber reinforced metal portion due to the difference between the linear expansion coefficient of the fibers and that of the matrix light metal alloy. For example, the coefficient of linear expansion of aluminum alloy is in the order of $20\times10^{-6}$/°C., and that of carbon fibers is about $-1.2\times10^{-6}$/°C. This means that, when the piston is repeatedly heated and cooled in response to engine stopping and restarting, the matrix metal located in the non-fiber-reinforced portion adjacent to the fiber-reinforced portion undergoes a considerable amount of repeated expansion and contraction, whereas the matrix metal located within the fiber reinforced portion remains substantially free from such expansion because of restraint by the reinforcing fibers. As a result, the matrix metal in the non-reinforced portion is subjected to a large stress which gives rise to cracks along the boundary of the fiber reinforced portion, as described later in more detail with reference to the drawings.

Another problems involved in light metal alloy pistons having fiber reinforced thermal struts arises from the recent requirement that the axial length of the piston be reduced. To meet this requirement, piston pin receiving bores machined in piston pin bosses must be located as close to the skirt shoulder portion as possible. This necessarily results in the thermal strut being cut out by machining of piston pin receiving bores, whereby the reinforcing fibers are exposed to the pin receiving bores. This presents the following disadvantages. First, since the fiber reinforced thermal strut is cut out at an acute angle, the ends of the strut are exposed within the piston pin receiving bores in a cantilever fashion to form sharp edges. As is well known, although reinforcing fibers such as carbon fibers exhibit a high tensile strength against an effort applied in the lengthwise direction thereof, they nevertheless have poor resistance against bending stress that is applied in the transverse direction. As the skirt shoulder is repeatedly compressed in the axial direction due to power pulses during operation of the engine, carbon fibers at the exposed edges of the thermal strut are broken and are removed from the matrix metal alloy. This causes cracks to occur, originating from the broken edges, and reduces the service life of the piston.

A second disadvantage resides in the difficulties in machining the piston pin receiving bore. Since the pin receiving bores are intended to slidingly engage with the piston pin, the inner surface of the bores must be machined to present a certain surface roughness. To this end, after the bores are drilled through the pin bosses, the bore surface is subjected to grinding. However, it has been difficult to obtain the desired surface roughness when the pin receiving bores intersect with the fiber reinforced thermal strut because machining of the carbon fiber is not feasible.

SUMMARY OF THE INVENTION

An object of the present invention is to provide a light metal alloy piston which is provided with a fiber reinforced thermal strut and which is usable throughout the desired service life of the engine without forming damageous cracks.

Another object of the invention is to provide a light metal alloy piston with a fiber reinforced thermal strut which is easy to manufacture.

This invention provides a light metal alloy piston having an annular thermal strut arranged within and along the shoulder portion of the piston skirt section. The thermal strut comprises an annular fiber-reinforced metal portion having a bundle of continuous high-tensile-strength inorganic fibers integrally molded within the matrix light metal alloy. According to the invention, the piston skirt section is so shaped that, except for the regions of piston pin bosses, a substantial part of the inner periphery of the thermal strut is exposed radially inwardly to the inside of the skirt section.

With this arrangement, substantially no matrix material is present inside the thermal strut, in the circumferential regions of the strut except for the regions of the piston pin bosses. Due to the lack of non-fiber-reinforced matrix metal that would otherwise be subjected to a large amount of expansion and contraction and, thus, would lead to the formation of cracks, the light metal alloy piston according to the invention is free from the problem of crack formation.

According to the preferred embodiment of the invention, wherein the piston pin receiving bores are located close to the skirt shoulder portion, the outer regions of the bores are enlarged so that the enlarged bores intersect the thermal strut at a larger angle. This reduces the circumferential length of the edges of reinforcing fibers exposed to the inside of the skirt section so that the bending resistance of the fibers at the exposed edges is increased. Another advantage of this arrangement is that the enlarged bore portions no longer serve as load bearing surfaces for the piston pin. Thus, it is unnecessary to control the surface roughness of the enlarged bore portions. The loads on the piston pin are supported only by the non-enlarged pin receiving bore portions which may be readily machined for a desired surface roughness because such bore portions do not intersect the reinforcing fibers.

In another preferred embodiment, the portions of the inner wall of the enlarged bores intersecting the thermal strut are made perpendicular to the thermal strut. The thermal strut is cut out along cutting planes which are perpendicular to the length of reinforcing fibers. Thus, the ends of the thermal strut appearing on the cutting planes do not present sharp or wedge-shaped edges. With this arrangement, there is no possibility of fiber edges being broken due to axial stress.

DESCRIPTION OF THE PREFERRED EMBODIMENTS

Figure 1:
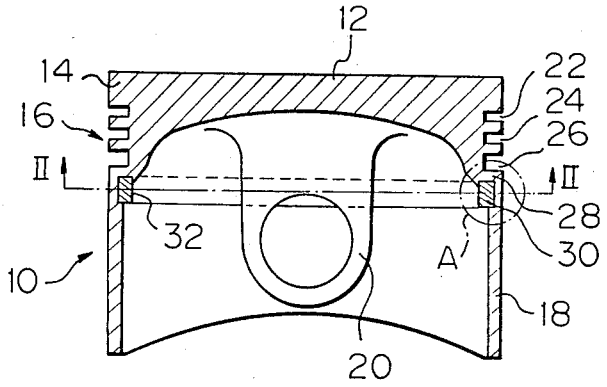
FIG. 1 is a cross-sectional view of the internal combustion engine piston according to the first embodiment of the invention, the section being taken along the line I—I of FIG. 2.
Figure 2:
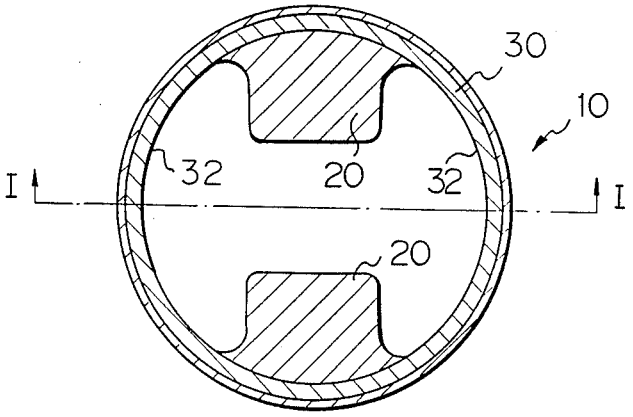
FIG. 2 is a cross sectional view taken along the line II—II of FIG. 1.

FIGS. 1 and 2 illustrate a piston according to the first embodiment of the invention. The piston 10 is made from a cast light metal alloy such as aluminum alloy and comprises a piston crown section 12, a top land section 14, a ring-belt section 16, a skirt section 18, and a pair of piston pin bosses 20. As in the conventional pistons, the ring-belt section 16 is provided with first and second ring grooves 22 and 24 for compression rings, and a third ring groove 26 for an oil control ring. The lower side wall of the third ring groove 26 defines a shoulder portion 28 of the skirt section 18. An annular thermal strut 30 is formed integrally within the mass of matrix metal alloy forming the skirt section 18.

The thermal strut 30 is spaced radially inwardly from the outer periphery of the skirt shoulder 28 and is spaced downwardly from the lower side wall of the third ring groove 26. The thermal strut 30 extends circumferentially along the outer periphery of the shoulder portion 28, as shown in FIG. 2. The thermal strut 30 extends within and through the mass of matrix metal forming the base of piston pin bosses 20 but the regions of the inner periphery 32 of the thermal strut 30 intermediate to the piston pin bosses 20 are exposed toward the inner cavity of the piston 10.

Figure 3:
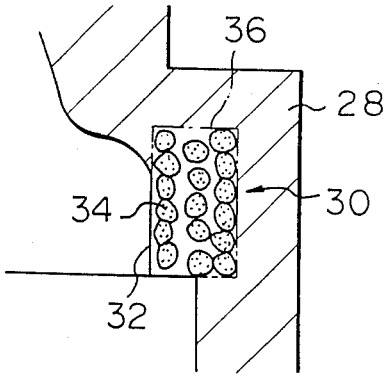
FIG. 3 is an enlarged cross-sectional view of the portion of the piston indicated by the circle A in FIG. 1.

As shown enlarged in FIG. 3, the thermal strut 30 is composed of an annular fiber reinforced metal portion which is formed integrally with the skirt shoulder 28. The fiber reinforced metal portion forming the thermal strut 30 comprises a yarn 34 of inorganic high-tensile-strength reinforcing fibers such as carbon fibers, the yarn 34 being wound in a circular manner for a plurality of turns. The yarn 34 includes, for example, several thousands of continuous individual carbon fibers which are integrally molded within the mass of matrix aluminum alloy that forms the thermal strut 30 together with the reinforcing carbon fibers. Individual carbon fibers are impregnated with the matrix alloy and are firmly bonded thereto to form the fiber reinforced metal portion. Although in FIGS. 1 and 3 the thermal strut 30 is shown as having a rectangular cross-section defined by a boundary indicated by the dotted line 36, actually there is no definite boundary between the fiber reinforced metal portion 30 and the adjacent area of the shoulder portion 28, because the matrix alloy is impregnated between the reinforcing fibers. The thermal strut 30 contains 40 to 60, preferably 45 to 50 percent by volume of carbon fibers.

Figure 4:
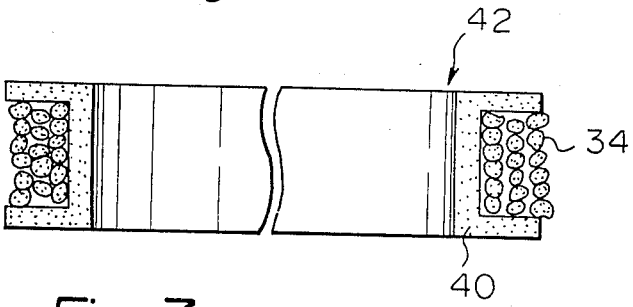
FIG. 4 is an enlarged cross-sectional view of a carbon fiber yarn as wound around a holder.

It should be noted that, except for the regions of the piston pin bosses 20, there is no substantial amount of non-fiber-reinforced portion inside of the inner periphery 32 of the fiber reinforced portion forming the thermal strut 30. Continuous carbon fibers having a low coefficient of linear thermal expansion enable the fiber reinforced portion to serve as a thermal strut that prevents thermal expansion of the skirt shoulder portion 28. The fiber reinforced portion constituting the thermal strut 30 is formed simultaneously with casting of the piston. Since in most instances the yarn 34 of carbon fibers is not sufficiently selfsustaining to retain its form during casting, it is desirable to use an annular yarn holder 40 as shown in FIG. 4. The holder 40 may be made from chopped inorganic fibers, such as aluminum silicate fibers, bonded together by suitable inorganic binder to form a rigid porous member containing less than about 7 percent by volume of chopped fibers. The yarn holder 40 has a circumferentially extending groove in which the yarn 34 is wound through a required number of turns. The thus formed assembly 42 is placed within a cavity of a die-casting machine and a molten aluminum alloy under pressure is injected therein and is allowed to cool to form the piston 10 having an integral fiber-reinforced thermal strut 30.

Figure 7:
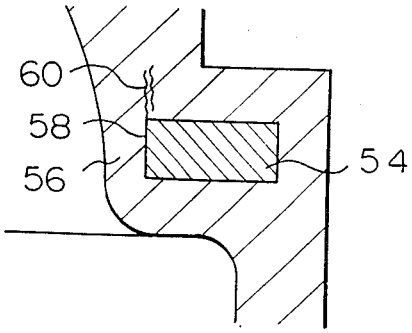
Fig. 7 PRIOR ART
FIG. 7. is an enlarged cross-sectional view of the portion of the piston indicated by the circle B in FIG. 5.
Figure 5:
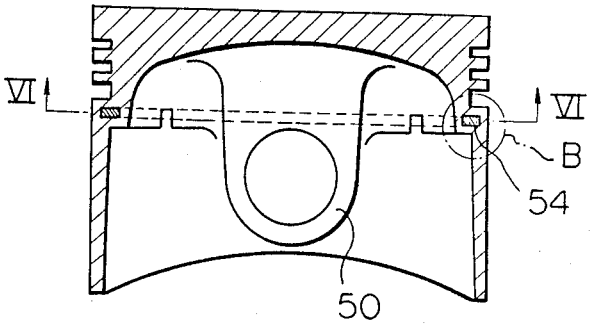
Fig. 5 PRIOR ART
FIG. 5 is a vertical cross-sectional view of the conventional light metal alloy piston.
Figure 6:
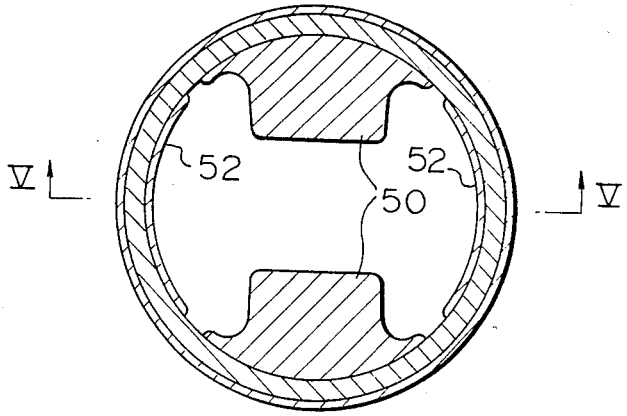
Fig. 6 PRIOR ART
FIG. 6 is a cross-sectional view taken along the line V—V of FIG. 5.

FIGS. 5 through 7 illustrate an example of the conventional piston having a thermal strut 54 consisting of a fiber reinforced metal portion. It will be noted that the thermal strut 54 is surrounded by or embedded within the non-fiber-reinforced matrix metal portion not only in the regions of the piston pin bosses 50 but also in the intermediate regions 52. In this conventional piston, the thermal strut 54 undergoes substantially no expansion when the piston is subjected to an elevated temperature because the reinforcing carbon fibers have a low or even negative coefficient of linear expansion of about $-1.2\times10^{-6}/°C$. However, since aluminum alloy has a high linear expansion coefficient of about $20\times10^{-6}/°C.$, the region 56 (FIG. 7) of the non-fiber-reinforced matrix metal that is located inside of the inner periphery 58 (FIG. 7) of the thermal strut 54 tends to expand, to exert a radial stress against the thermal strut 54. When the piston is repeatedly heated and cooled in response to the engine stopping and starting, the application and release of the radial stress are repeated thereby resulting in fatigue of the matrix metal along the inner periphery 58. It is believed that this causes the formation of cracks 60 in the skirt shoulder portion.

In the piston according to the invention, no substantial amount of non-fiber-reinforced metal is present inside of the inner periphery of the thermal strut 30, except for the regions of the piston pin bosses 20. The formation of cracks is avoided due to the absence of a non-fiber-reinforced metal portion that would otherwise give rise to radial stress. Since the piston pin bosses 20 are massive and have an adequate rigidity, the reinforcing fibers located in these regions are stretched in response to thermal expansion of the pin bosses. Therefore, there is no likelihood of the development of any excessive radial stress along the inner periphery of the thermal strut in the regions of the piston pin bosses 20.

Figure 8:
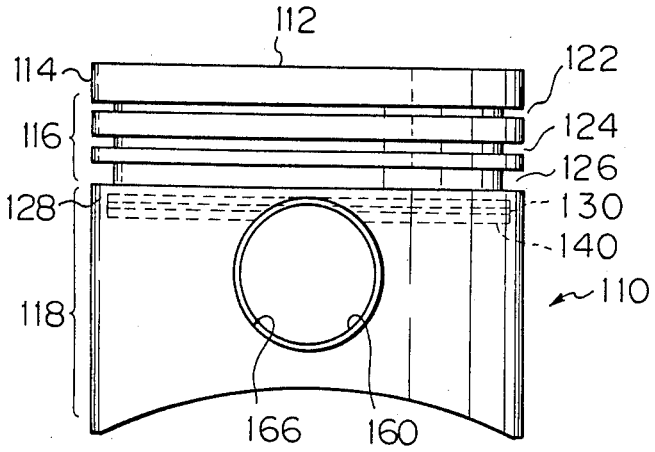
FIG. 8 is a side elevational view of the piston according to the second embodiment of the invention.
Figure 9:
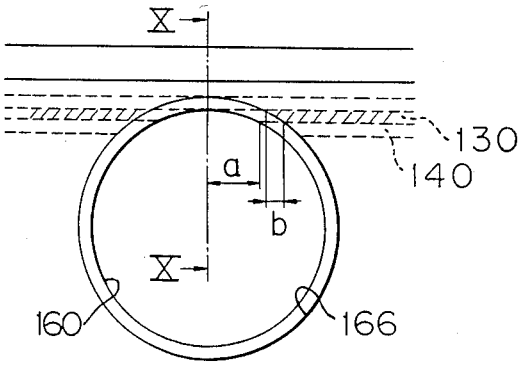
FIG. 9 is an enlarged side elevational view of a portion of the piston shown in FIG. 8.
Figure 10:
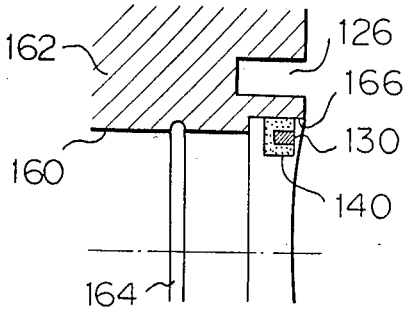
FIG. 10 is a cross-sectional view taken along the line X—X of FIG. 9.

FIGS. 8 through 10 illustrate a second embodiment of the invention. The piston 110 includes a piston crown section 112, a top land section 114, a ring-belt section 116, and a skirt section 118. The ring belt section 116 has ring grooves 122, 124, and 126. As in the first embodiment, the skirt shoulder portion 128 is provided with a thermal strut 130 comprising continuous carbon fibers. The carbon fibers are carried by a yarn holder 140 and are integrally molded within the matrix aluminum alloy. As described with reference to the first embodiment, the inner periphery of the thermal strut 130 is exposed radially inwardly toward the inner cavity of the piston except for the regions of the piston pin bosses.

The skirt section 118 has a pair of piston pin receiving bores 160 extending therethrough and through piston pin bosses, one of which is partly indicated at 162 in FIG. 10. Each bore 160 has an annular groove 164 for receiving a circlip for retaining a piston pin. As best shown in FIGS. 9 and 10, the outer region of each bore 160 is stepped to form an enlarged bore 166. The bore 160 is positioned close to the skirt shoulder portion 128 in such a manner that the extension thereof is substantially tangential to the upper periphery of the thermal strut 130. The enlarged bore 166 has a diameter large enough to entirely intersect the thermal strut 130 and to cut it apart to form the pair of opposed edges appearing in the enlarged bore 166.

The advantages of the enlarged bore structure will be described with reference to FIG. 9. Provided the outer regions of the bore 160 are not enlarged and the bore 160 has a uniform diameter throughout its length, the thermal strut 130 would be cut out to present a relatively long, relatively sharp, wedge shaped edge having a circumferential length of a. When the piston exhibits strain under the power pulse applied thereon in each power stroke of the engine, individual carbon fibers molded in the matrix metal of thermal strut will be subjected to axial bending force by which the carbon fibers in the edge of the thermal strut will be broken into sections due to the low bending strength of carbon fibers. The broken fibers will be loosened from the matrix metal and be removed therefrom.

According to the second embodiment, the circumferential length of the edge of the thermal strut is reduced to b due to the thermal strut being cut out by the enlarged bore 166 at a larger angle. The area of the end surface of the strut appearing in the enlarged bore is also reduced. The reduction in the edge length and the reduction in the surface area considerably reduce the bending moment applied to individual carbon fibers in the edge and thereby reduce the possibility of fiber breakage.

Another advantage of this embodiment is that the enlarged bore 166 no longer serves as a bearing surface for the piston pin. Thus, the enlarged bore need not be machined to present a specified surface roughness and, therefore, may be easily formed by simple drilling. The enlarged bore 166 will not hinder access to the smaller bore 160 which may then be machined to obtain the required surface roughness.

Figure 11:
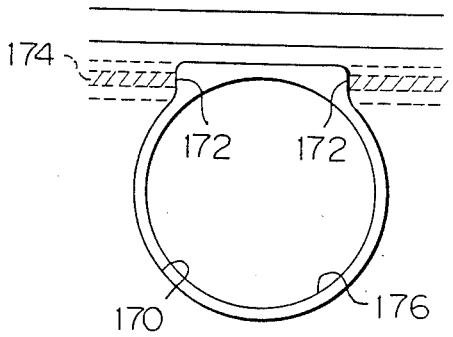
FIG. 11 is a view similar to FIG. 9 but showing the third embodiment of the invention.

FIG. 11 shows a third embodiment of the invention wherein the configuration of the enlarged bore is modified. Other parts of the piston are the same as those described with reference to the first and second embodiments. In this embodiment, the enlarged bore 170 is further machined to make portions 172 of the inner wall of the enlarged bore 170 perpendicular to the thermal strut 174. The smaller bore 176 is cylindrical and acts as a bearing surface for the piston pin. In this embodiment, the cutting plane lies at a right angle with respect to the lengthwise direction of the thermal strut so that the end of the thermal strut does not present wedge shaped edges. The area of the end surface of the strut is minimum. Therefore, the axial force which is applied to individual carbon fibers is minimized and the possibility of fiber breakage is entirely avoided.

EXAMPLE

A yarn holder 40 as shown in FIG. 4 was first prepared. To this end, chopped aluminum silicate fibers, commercially available from Isolite Kogyo K.K. of Japan under the trademark "Kaowool", were dispersed in an aqueous medium containing suitable inorganic binder additives. The dispersion was filtered by vacuum filtration through a tubular mesh to form thereon a tubular aggregate of chopped fibers. The aggregate was dried, sintered, and machined to form the grooved holder 40. The bulk density of the holder was 0.2 g/cm $^2$ and the content by volume of the fibers was 7%.

Then, a yarn 34 having 6,000 carbon fibers, commercially available from Toray Inc. of Japan under the trademark "Treca M40", was wound around the holder 40 for 18 turns by a yarn winder to form an assembly 42 consisting of the holder and the wound yarn. The ends of the yarn were bonded by an aluminum silicate adhesive. The content by volume of carbon fibers was about 45%.

The assembly 42 was preheated to 750° C. and positioned within a cavity of a high pressure die-casting machine. A molten aluminum alloy (JIS AC8A) at 730° C. was poured into the cavity under a pressure of about 1,000 kg/cm$^2$, and was allowed to cool for consolidation. The casting was heat-treated and machined to form a piston 10, shown in FIGS. 1 through 3, having an outer diameter of 84 mm and an axial length of 75 mm.

The pistons 10 according to the invention and the conventional pistons were mounted on four-cycle six-cylinder gasoline engines having a displacement of about 2.8 liters, maximum output of 180 PS, maximum speed of 5,600 rpm, and maximum torque of 24.2 kg·m at 4,400 rpm. The engines were operated for about 200 hours while conducting a thermal shock test by varying the coolant temperature between −30° C. and 105° C. and lubricant temperature between −30° C. and 150° C. for a cycle of about 30 minutes. In the conventional pistons, cracks as shown in FIG. 7 were formed after 50 hours operation. However, no cracking was observed in the piston according to the invention even after 200 hours of operation.

We claim:

1. A light metal alloy piston for an internal combustion engine, comprising: a skirt section, a pair of diametrically opposed piston pin bosses integral with said skirt section and disposed adjacent to a shoulder portion of the skirt section, said bosses having piston pin receiving bores, said piston further including an annular thermal strut arranged within and along the outer periphery of the shoulder portion of the skirt section to suppress thermal expansion of the skirt section, said thermal strut including an annular fiber-reinforced metal portion having a bundle of high-tensil-strength fibers integrally molded within a matrix light metal alloy forming said piston, said skirt section being shaped such that except for the regions of said piston pin bosses, a substantial portion of the circumferential inner periphery of said thermal strut is exposed radially inwardly to the inside of the skirt section in order to avoid presence of any substantial amount of non-fiber-reinforced matrix metal at the inside of the inner periphery of the thermal strut, said thermal strut being defined in a substantially horizontal plane at a vertical height corresponding to a vertical height of said bores whereby the outer regions of said bores intersect said thermal strut, said outer regions of said bores being enlarged whereby the portions of the strut adjacent to the bores are cut out when said bores are formed.

2. A piston according to claim 1, wherein the portions of the inner wall of the enlarged bores that intersect the thermal strut are made perpendicular to the thermal strut.

* * * * *